US007234428B2

(12) United States Patent
Nagel et al.

(10) Patent No.: US 7,234,428 B2
(45) Date of Patent: Jun. 26, 2007

(54) CAM SHAFT ASSEMBLY FOR AN ENGINE

(75) Inventors: John J. Nagel, Hartford, WI (US); John A. Zbiegien, Jr., Cedarburg, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 63 days.

(21) Appl. No.: 11/191,834

(22) Filed: Jul. 28, 2005

(65) Prior Publication Data

US 2007/0022984 A1 Feb. 1, 2007

(51) Int. Cl.
*F01L 1/04* (2006.01)

(52) U.S. Cl. ..... 123/90.6; 123/90.27; 123/90.37; 29/888.1; 74/567

(58) Field of Classification Search ..... 123/90.6, 123/90.37, 90.27; 29/888.1; 74/567
See application file for complete search history.

(56) References Cited

U.S. PATENT DOCUMENTS

| | | | | |
|---|---|---|---|---|
| 4,984,539 | A | 1/1991 | Shinoda et al. | |
| 5,307,708 | A | 5/1994 | Matt | |
| 5,351,663 | A | 10/1994 | Makimura et al. | |
| 5,497,679 | A | 3/1996 | Mitchell et al. | |
| 5,497,735 | A | 3/1996 | Kern et al. | |
| 5,724,860 | A | 3/1998 | Sekiguchi et al. | |
| 5,797,180 | A | 8/1998 | Buchholz | |
| 5,826,461 | A | 10/1998 | Kaywood et al. | |
| 5,860,328 | A | 1/1999 | Regueiro | |
| 5,947,070 | A * | 9/1999 | Immel et al. | 123/90.6 |
| 5,947,075 | A | 9/1999 | Ryu et al. | |
| 5,992,265 | A | 11/1999 | Klaar | |
| 6,499,453 | B1 | 12/2002 | Immel et al. | |
| 6,672,273 | B2 * | 1/2004 | Ito et al. | 123/196 R |
| 2004/0000213 | A1 | 1/2004 | Hamamoto et al. | |

* cited by examiner

*Primary Examiner*—Thomas Denion
*Assistant Examiner*—Zelalem Eshete
(74) *Attorney, Agent, or Firm*—Michael Best & Friedrich LLP

(57) ABSTRACT

An internal combustion engine including an engine housing having a cam chamber and an aperture providing access to the cam chamber. The engine also includes an insert at least partially made from plastic received within the aperture, a crankshaft coupled to the engine housing for rotation about a crank axis, and a cam shaft defining a cam shaft axis and at least partially made from plastic that is rotatably driven by the crankshaft. The cam shaft includes first and second ends and at least one cam lobe positioned between the ends. The first end is rotatably supported by the engine housing and the second end is rotatably supported by the insert. The engine also includes a metal portion coupled to either the insert or the cam shaft. The metal portion defines a flange having a face in contact with an adjacent surface of the other of the insert and the cam shaft.

6 Claims, 8 Drawing Sheets

CAM SHAFT ASSEMBLY FOR AN ENGINE

BACKGROUND

The present invention relates to a four-cycle engine comprising a piston that reciprocates in a horizontally oriented cylinder and drives a vertically oriented crankshaft.

SUMMARY

In one embodiment, the invention provides an internal combustion engine including an engine housing having a cam chamber and an aperture providing access to the cam chamber. The engine also includes an insert at least partially made from plastic and received within the aperture, a crankshaft coupled to the engine housing for rotation about a crank axis, and a cam shaft defining a cam shaft axis that is at least partially made from plastic and is rotatably driven by the crankshaft. The cam shaft includes first and second ends and at least one cam lobe positioned between the ends. The first end is rotatably supported by the engine housing and the second end is rotatably supported by the insert. The engine also includes a metal portion coupled to either the insert or the cam shaft. The metal portion defines a flange having a face in contact with an adjacent surface of the other of the insert and the cam shaft.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
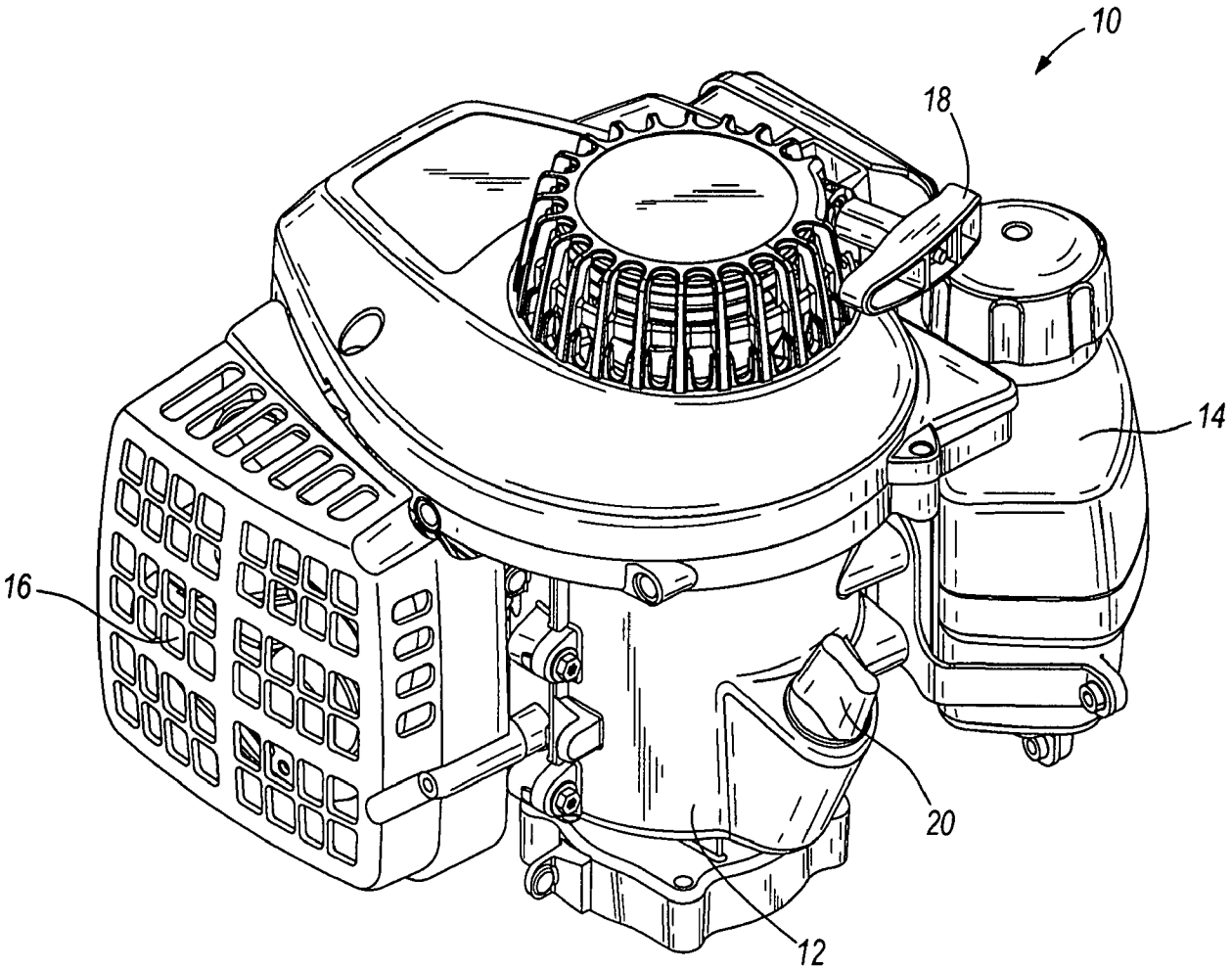
FIG. 1 is a perspective view of a four-cycle vertical-shaft engine embodying the present invention.

FIG. 1 illustrates a single-cylinder, four-cycle, vertical-shaft internal combustion engine 10. A vertical-shaft engine is one in which the crankshaft is oriented vertically and the piston is oriented horizontally in the typical operating position of the engine. The most typical application for an engine of this type is powering a lawnmower, but it could be adapted for any situation in which a vertically oriented crankshaft is required. For example, the engine could be used to power other lawn and garden equipment, outdoor power equipment, augers, cultivators, a pump of a pressure washer, or to power a generator.

Figure 6:
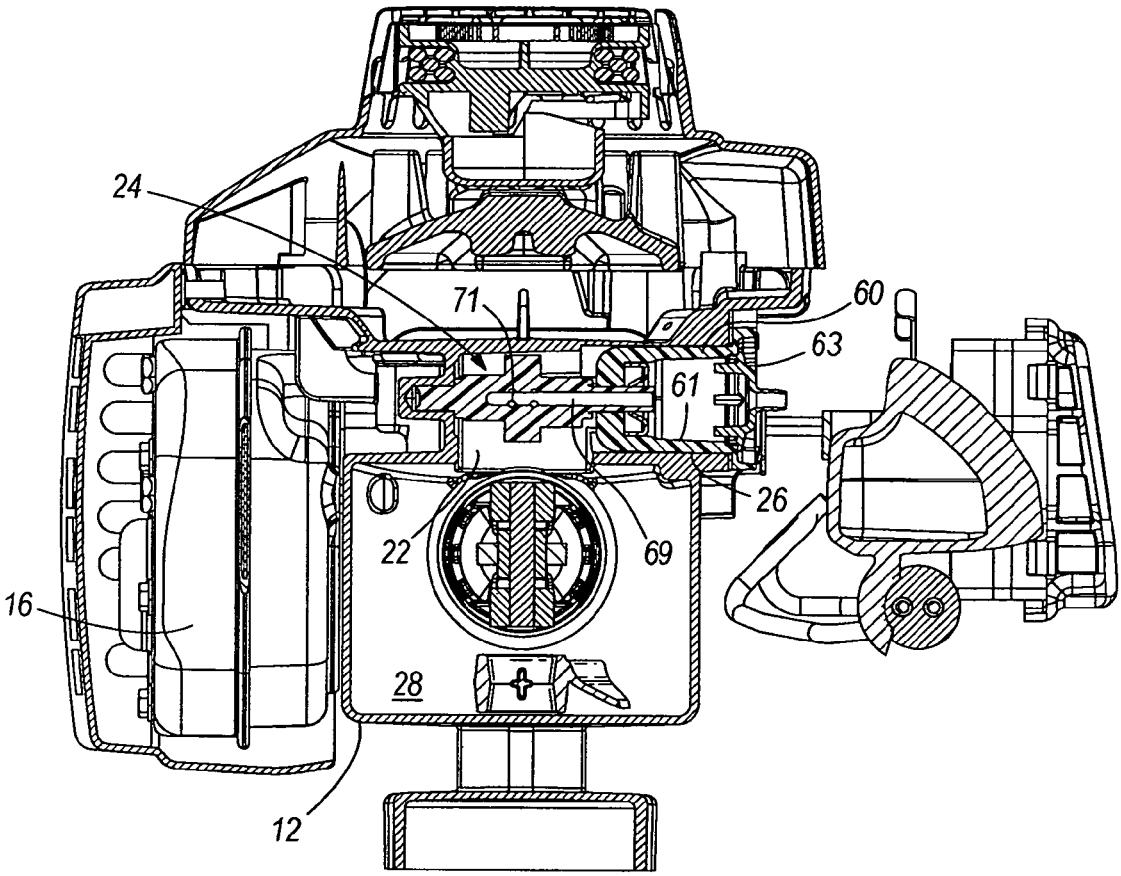
FIG. 6 is a cross section view taken along line 6-6 of FIG. 5, illustrating the interaction between the cam shaft assembly and a plastic insert.

The engine includes an engine housing 12, a fuel tank 14, a muffler 16, a pull-start mechanism 18, and an oil dipstick 20. The engine housing defines a cam chamber 22 (FIG. 6) adapted to receive and at least partially rotatably support a cam shaft assembly 24 for operation within the cam chamber 22. The chamber is accessible from one end through an aperture 26 in the engine housing 12 (FIG. 6). The engine housing also defines a crank chamber 28 (FIG. 4) adapted to receive and rotatably support a crankshaft assembly 30 (FIG. 4) for operation within the crank chamber 28.

Figure 2:
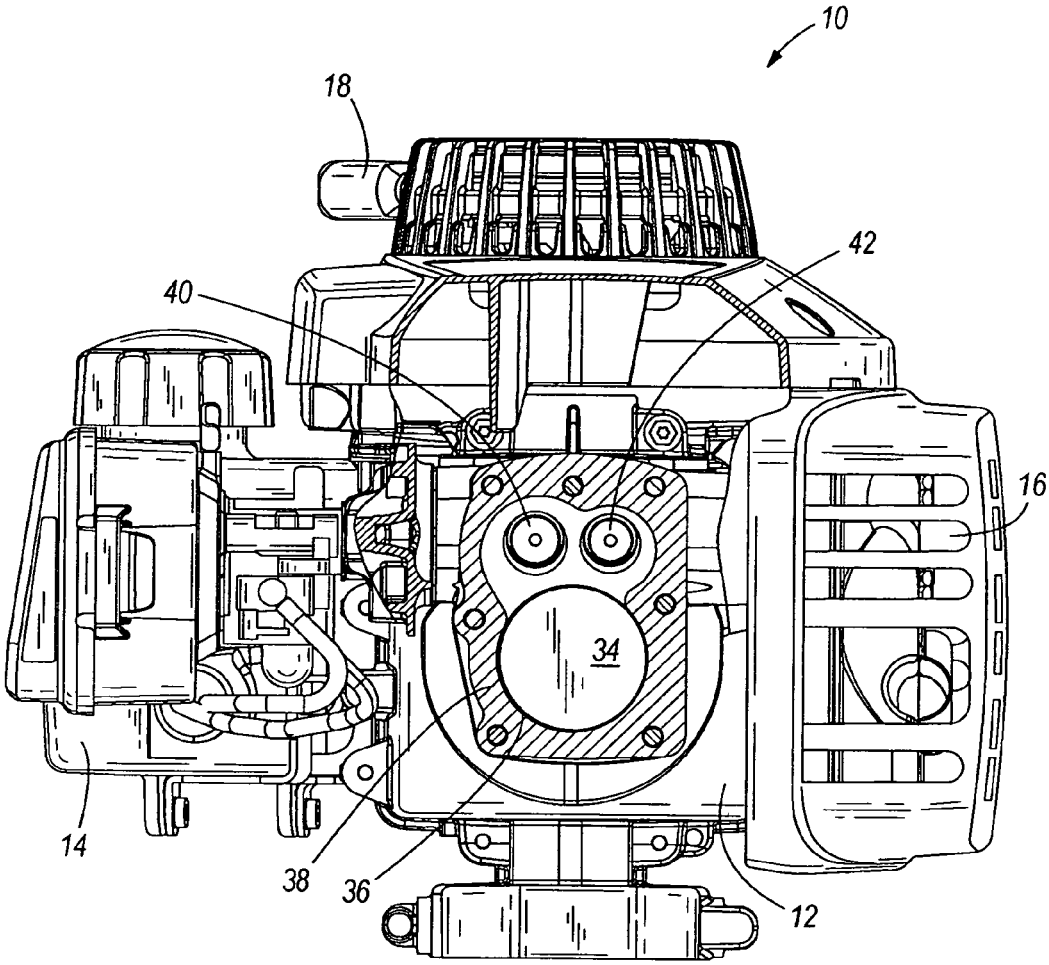
FIG. 2 is a partially cut away side view of the engine of FIG. 1, illustrating the engine with the cylinder head removed.

FIG. 2 depicts a side view of the engine 10 with a cylinder head 32 removed. The top of a piston 34 is shown slidably received within a cylinder bore 36 located within a cylinder 38, which is integrally formed with the engine housing 12. An intake valve 40 and exhaust valve 42 are located adjacent and in fluid communication with the cylinder 38. The cylinder 38 and cylinder head 32 combine to form a combustion chamber (not shown). Each of the intake valve 40, exhaust valve 42 and piston 34 are in communication with the combustion chamber. The valves of the illustrated engine 10 are located within the cylinder 38 and communicate with the combustion chamber from the side of the cylinder bore 36. This type of engine 10 is referred to as an L-head or side valve engine. The present invention is not limited to use with this engine design and can be used on any style engine such as an overhead valve or cam engine, where the valves or cams are positioned within the cylinder head.

Figure 3:
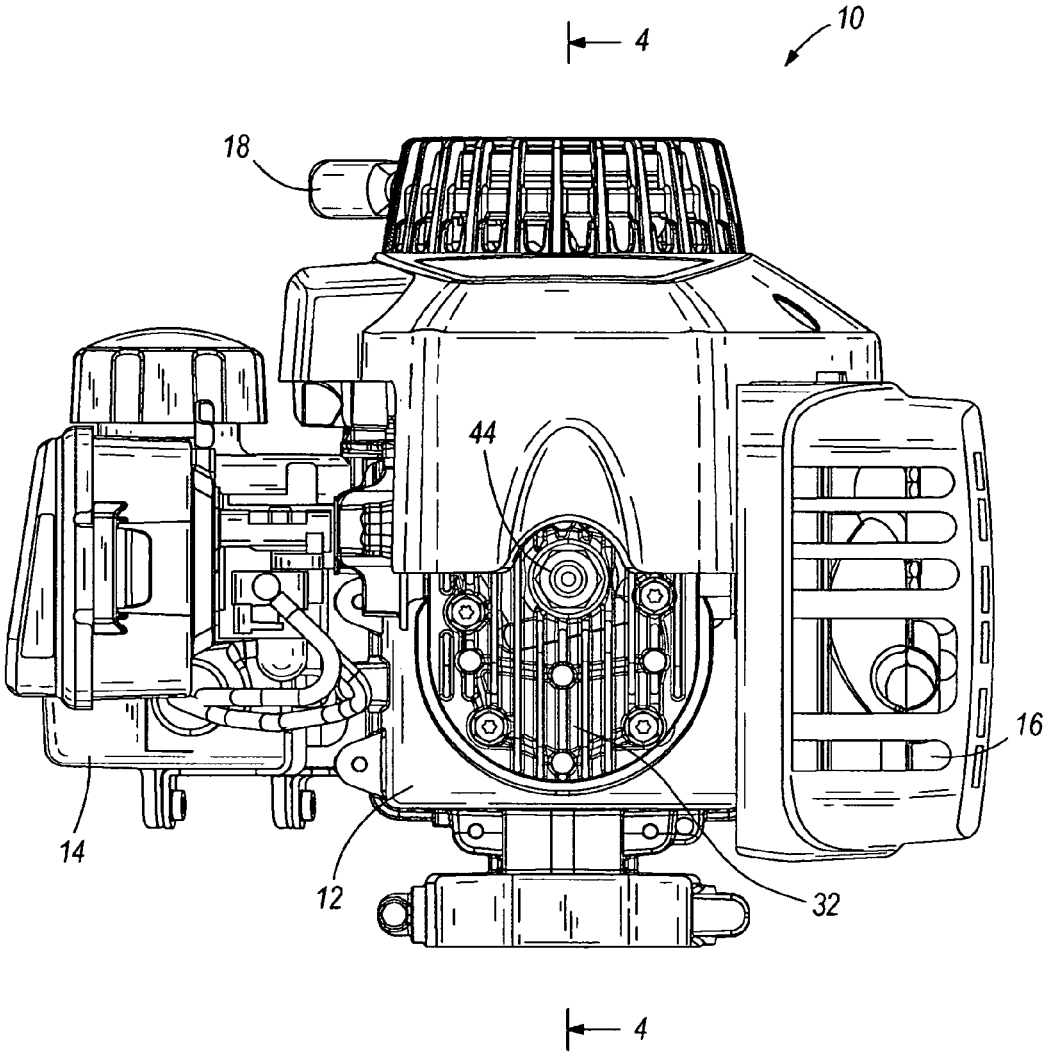
FIG. 3 is the same side view as FIG. 2, illustrating the engine with the cylinder head installed.

FIG. 3 depicts the same side view of the engine 10 as FIG. 2 except it illustrates the cylinder head 32. A spark plug 44 is threaded into the cylinder head 32 and is in fluid communication with the combustion chamber.

Figure 4:
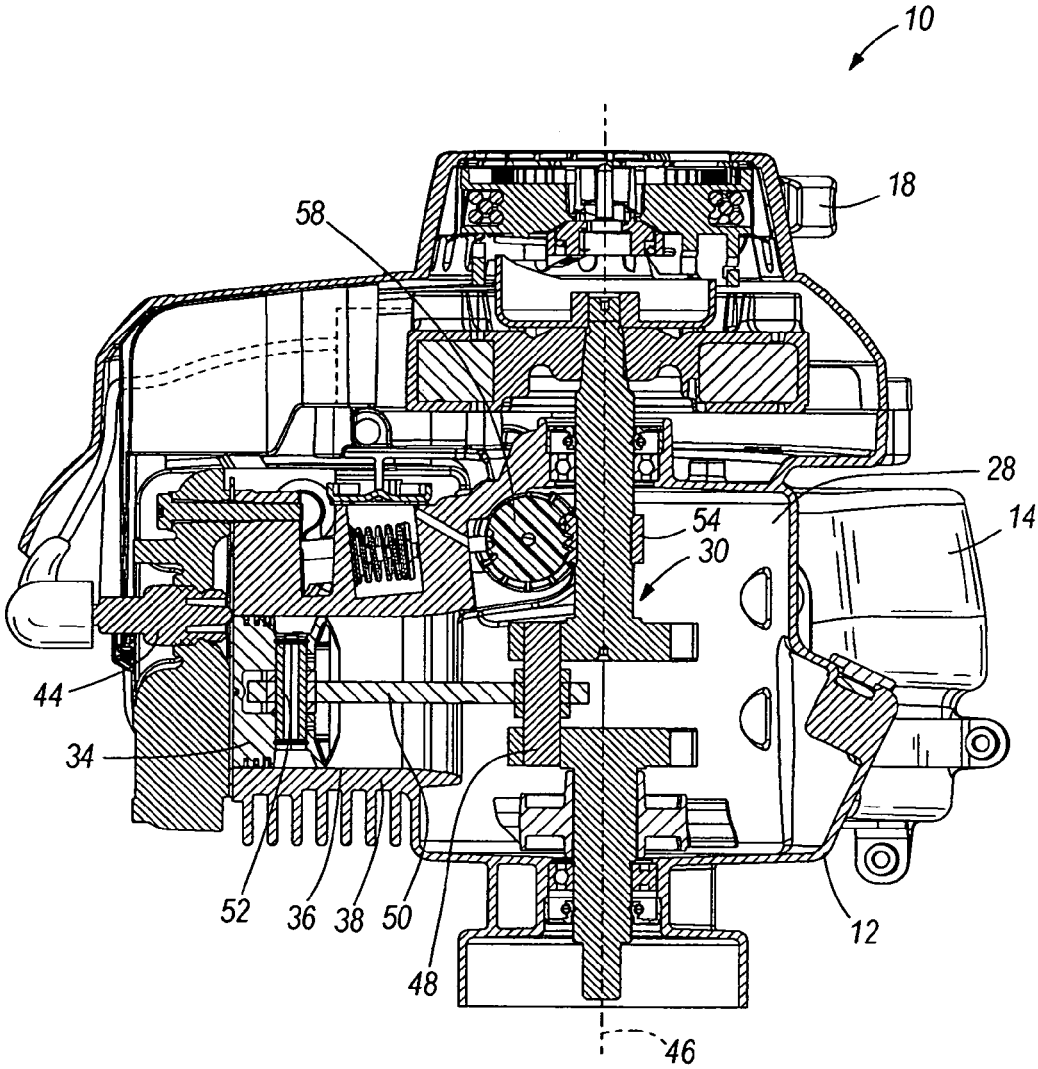
FIG. 4 is a cross section view taken along line 4-4 of FIG. 3, illustrating the interaction between a crankshaft and a cam shaft assembly.
Figure 5:
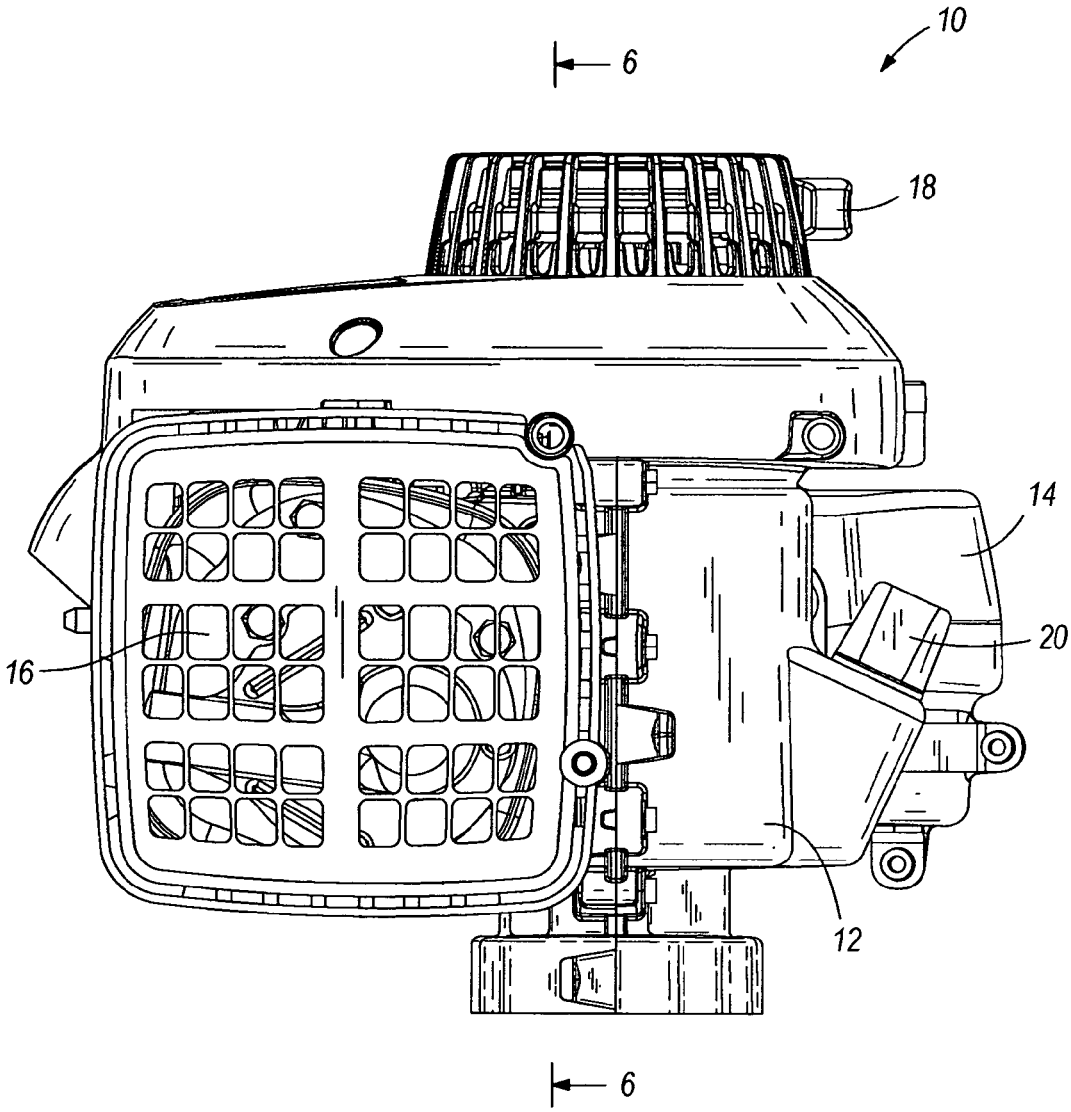
FIG. 5 is another side view of the engine of FIG. 1.

FIG. 4 is a cross section of the engine 10 taken along the crank axis 46. The crankshaft assembly 30 is rotatably supported by the engine housing 12 and rotates within the crank chamber 28. The crankshaft assembly 30 includes shaft portions that are interconnected by a crank pin 48. A connecting rod 50 is rotatably connected to the crank pin 48 at a first end and rotatably connected to the piston 34 through a wrist pin 52 at a second end in such a way that as the piston 34 reciprocates in the cylinder bore 36, the crankshaft assembly 30 rotates about the crank axis 46. A crank helical gear 54 is disposed on the crankshaft assembly 30 for rotation with the crankshaft assembly 30.

Figure 8:
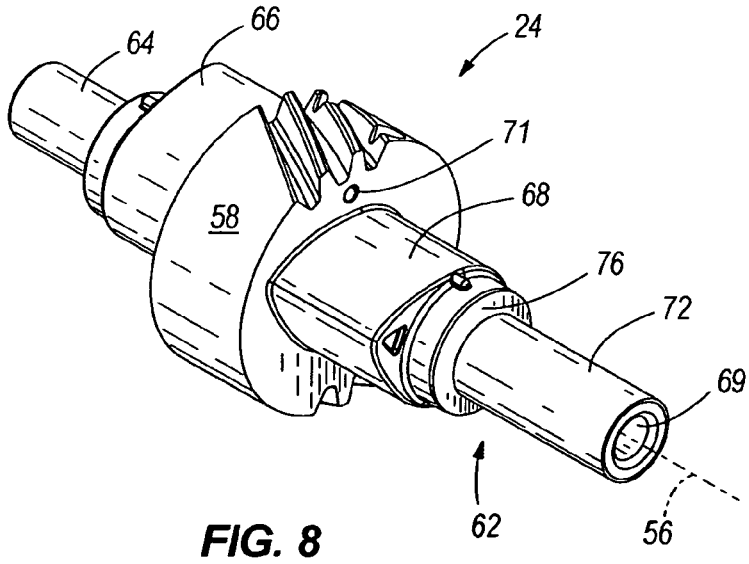
FIG. 8 is a perspective view similar to FIG. 8, illustrating the metal sleeve attached to the cam shaft.

With further reference to FIGS. 6 and 8, the cam shaft assembly 24 is supported by the engine housing 12 for rotation about a cam shaft axis 56, which is oriented normal to the crank axis 46. A cam helical gear 58 is included in the cam shaft assembly 24 for rotation with the cam shaft assembly 24 and engages the crank helical gear 54 such that the cam shaft assembly 24 is rotatably driven by the crankshaft assembly 30.

Figure 7:
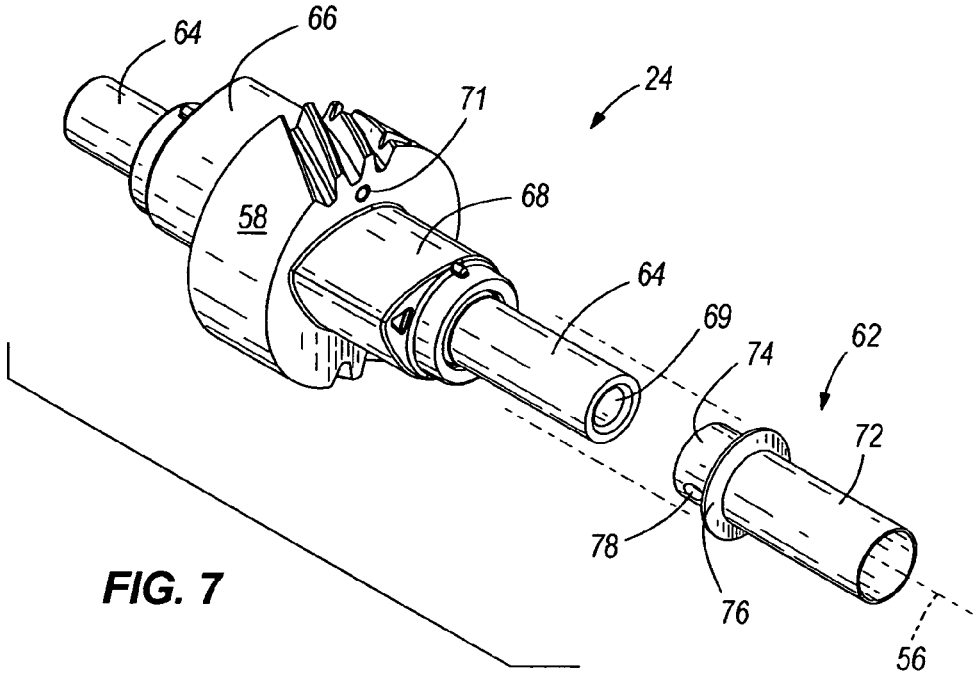
FIG. 7 is an exploded perspective view of the cam shaft assembly of FIG. 9, illustrating a metal sleeve separated from the cam shaft.

FIG. 7 is an exploded view of the cam shaft assembly 24. FIG. 8 depicts a metal sleeve 62 installed on the second end of the cam shaft assembly 24. The cam shaft assembly 24 includes a cylindrical cam shaft 64, first and second lobes 66 and 68, the cam helical gear 58, and the metal sleeve 62. The first lobe 66 is disposed on a first side of the cam helical gear 58 and the second lobe 68 is disposed on a second side of the cam helical gear 58. The lobes have a non-circular profile that is shaped like a cross-section of an egg, with a single high point on either lobe corresponding to the open position of the intake valve 40 or exhaust valve 42. Each lobe is oriented so that its high point is angularly offset from the other lobe's high point so that the intake valve 40 and exhaust valve 42 are actuated at different times.

With further reference to FIG. 6, the cam shaft assembly 24 also includes an axial passageway 69 that is exposed to the second end of the cam shaft assembly 24. The axial passageway 69 fluidly communicates with the cam chamber 22 through radial apertures 71 and through the cam helical gear 58. The radial apertures 71, axial passageway 69, insert 60, and fitting 63 define an oil separating breather system allowing oil-free blow-by gases from the crank chamber 28 and cam chamber 22 to be released to the intake system of the engine 10.

With reference to FIG. 7, the metal sleeve 62 includes a first cylindrical portion 72 and a second cylindrical portion 74, separated by a flange 76. The second cylindrical portion 74 is shorter than the first cylindrical portion 72 and contains an aperture 78 in its side wall.

The cam shaft 64, lobes 66 and 68, and cam helical gear 58 are preferably a single piece of plastic formed during an injection molding operation. Prior to forming the cam shaft 64, the metal sleeve 62 is inserted into a die (not shown) used to mold the cam shaft 64. As the die is filled with heated liquid plastic, the metal sleeve 62 becomes an integral part of the cam shaft assembly 24. When the molding operation is finished, the second cylindrical portion 74 is disposed on the shaft 64, and rests beneath the cam lobe 68. In addition, plastic is forced into the aperture 78 in the second cylindrical portion 74 of the metal sleeve 62. This allows the metal sleeve 62 to resist rotation with respect to the cam shaft 64.

FIG. 6 is a cross section of the engine 10 taken through the cam shaft axis 56 and normal to the crank axis 46. The cam shaft assembly 24 is rotatably supported in the cam chamber 22 at a first end by the engine housing 12, and rotatably supported at a second end by a plastic insert 60. The insert 60 is a substantially cylindrical hollow piece received within the cam chamber aperture 26. A first end of the insert 60 includes an aperture that receives and rotatably supports the second end of the cam shaft assembly 24. A second end of the insert 60 is flanged. The flange is larger than the aperture 26 and provides a positive interface between the insert 60 and the exterior of the engine housing 12. The second end of the insert 60 also includes an aperture 61 that receives a fitting 63. The fitting 63 connects to a hose (not shown) that is fluidly connected to the intake system of the engine 10.

Figure 9:
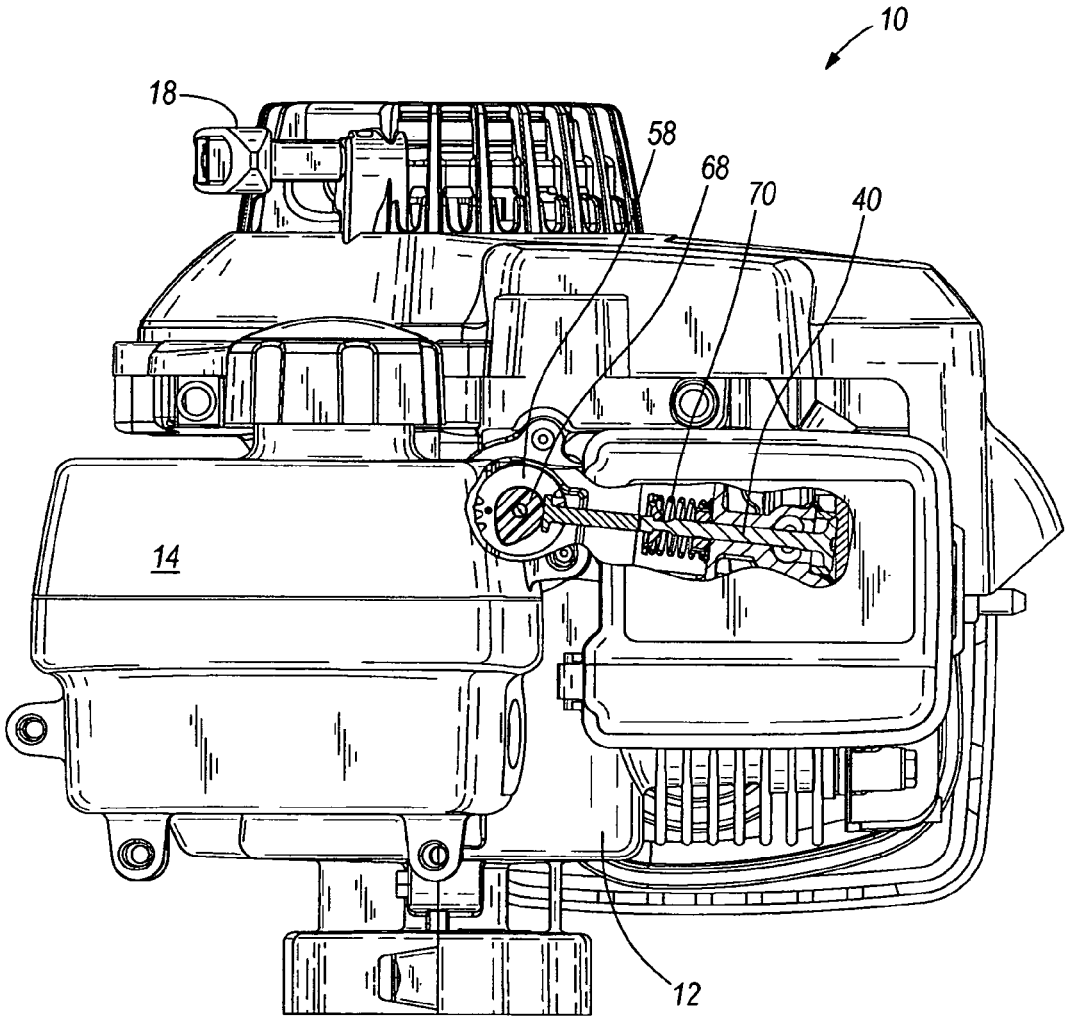
FIG. 9 is a partially cut away side view of the engine of FIG. 1, illustrating the interaction between a cam lobe and a valve.

FIG. 9 is a side view of the engine 10 with a cutout showing a section view of the cam lobe 68, the cam helical gear 58, a valve spring 70, and the intake valve 40. The cam lobe 68 is disposed on the cam shaft 64 (FIGS. 7 and 8) for rotation with the cam shaft assembly 24, and is slidingly engaged with the intake valve 40. Cam lobe 66 (FIG. 7) is located behind the cam helical gear 58 and is slidingly engaged with the exhaust valve 42 (not shown). As the cam shaft assembly 24 is rotatably driven about the cam shaft axis 56 by the crankshaft assembly 30, the cam lobe 68 rotates with the cam shaft assembly 24, forcing the intake valve 40 to reciprocate between open and closed positions. The intake valve 40 and exhaust valve 42 are substantially identical in form, function, and mounting style.

During assembly of the engine 10, the cam shaft assembly 24 is inserted into the cam chamber 22 through the aperture 26 in the engine housing 12. When the first end of the cam shaft assembly 24 is supported by the engine housing 12, the plastic insert 60 is placed into the cam chamber aperture 26 to rotatably support the second end of the cam shaft assembly 24 and keep it in place.

During operation of the engine 10, the crank helical gear 54 is drivingly engaged with the cam helical gear 58, rotating the cam shaft assembly 24 and creating a thrust force on the cam shaft assembly 24 along the cam shaft axis 56 toward the second end of the cam shaft assembly 24. As stated, the second end of the cam shaft assembly 24 is rotatably supported by the plastic insert 60. The metal sleeve 62 of the cam shaft assembly 24 is positioned so that the flange 76 serves as a thrust face on the cam shaft assembly 24 against the corresponding face on the plastic insert 60. This significantly reduces wear and allows the cam shaft assembly 24 and insert 60 to advantageously be made partially or entirely of plastic.

In alternate embodiments, the plastic insert 60 may include a metal portion to act as a thrust face, negating the need for the metal sleeve 62 on the cam shaft 64. The invention is also not necessarily limited to being cylindrical or resembling a sleeve. As long as a metal to plastic interface defines the thrust face between the cam shaft and the engine housing, the metal portion discussed can take on any relative shape.

Thus, the invention provides, among other things, a new and useful cam shaft assembly for a four-cycle, vertical-shaft engine. More particularly, the invention provides a new and useful cam shaft assembly that includes a metal portion defining a thrust face that allows the cam shaft to be advantageously manufactured from plastic. Various features and advantages of the invention are set forth in the following claims.

What is claimed is:

1. An internal combustion engine, comprising:

an engine housing including a cam chamber and an aperture providing access to the cam chamber;

a crankshaft coupled to the engine housing for rotation about a crank axis;

an insert at least partially made from plastic disposed adjacent the aperture;

a cam shaft at least partially made from plastic defining a cam shaft axis rotatably driven by the crankshaft, the cam shaft having first and second ends and at least one cam lobe positioned between the ends, the first end rotatably supported by the engine housing, the second end rotatably supported by the plastic insert; and a metal portion coupled to one of the plastic insert and the plastic cam shaft, the metal portion defining a flange having a face in contact with an adjacent surface of the other of the plastic insert and the plastic cam shaft, and wherein the metal portion is a flanged sleeve disposed on the cam shaft.

2. The engine of claim 1, wherein the cam shaft axis is oriented normal to the crank axis.

3. The engine of claim 2, wherein the crankshaft includes a helical gear and the cam shaft includes a helical gear drivingly engaged with the helical gear of the crankshaft, the helical gears creating a thrust force in a direction along the cam shaft axis during engine operation.

4. The engine of claim 1, wherein the flanged metal sleeve is co-molded with the cam shaft in an injection molding operation.

5. The engine of claim 4, wherein the flanged metal sleeve includes an aperture adapted to receive plastic during the injection molding operation.

6. The engine of claim 4, wherein the flanged metal sleeve distributes thrust forces in the direction of the cam shaft axis.

* * * * *